US010456821B2

(12) United States Patent
Vahle

(10) Patent No.: US 10,456,821 B2
(45) Date of Patent: Oct. 29, 2019

(54) FINE BLANKING CAM DIE

(71) Applicant: MAGNA POWERTRAIN INC., Concord (CA)

(72) Inventor: Harold Vahle, Richmond Hill (CA)

(73) Assignee: MAGNA POWERTRAIN INC., Concord (CA)

( * ) Notice: Subject to any disclaimer, the term of this patent is extended or adjusted under 35 U.S.C. 154(b) by 381 days.

(21) Appl. No.: 15/286,760

(22) Filed: Oct. 6, 2016

(65) Prior Publication Data

US 2017/0106427 A1 Apr. 20, 2017

Related U.S. Application Data

(60) Provisional application No. 62/241,358, filed on Oct. 14, 2015.

(51) Int. Cl.
*B21D 28/16* (2006.01)
*B21D 28/14* (2006.01)

(52) U.S. Cl.
CPC ..... *B21D 28/14* (2013.01); *B21D 28/16* (2013.01)

(58) Field of Classification Search
CPC ..... B21D 28/14; B21D 28/16; B21D 28/10; B21D 28/04; B21D 19/084; B30B 1/26; B30B 1/261
USPC ..... 72/336, 337, 332, 333, 381, 382
See application file for complete search history.

(56) References Cited

U.S. PATENT DOCUMENTS

| | | | | | |
|---|---|---|---|---|---|
| 2,554,916 | A * | 5/1951 | Miller | B21D 24/16 | 72/333 |
| 2,700,407 | A | 1/1955 | Trimble | | |
| 3,393,550 | A | 7/1968 | Ihle | | |
| 3,834,211 | A | 9/1974 | Daniels | | |
| 4,774,865 | A | 10/1988 | Wallis | | |
| 4,985,993 | A * | 1/1991 | Yagi | B21D 53/30 | 29/894.353 |
| 7,434,443 | B2 | 10/2008 | Tokuda | | |
| 9,895,738 | B2 * | 2/2018 | Hattori | B21D 28/32 | |
| 2009/0010723 | A1 | 1/2009 | Grimm | | |
| 2009/0090157 | A1 | 4/2009 | Schlatter | | |
| 2009/0165525 | A1 | 7/2009 | Schlatter et al. | | |
| 2012/0125067 | A1 | 5/2012 | Torizuka et al. | | |

FOREIGN PATENT DOCUMENTS

| | | | | |
|---|---|---|---|---|
| JP | S55103234 A | 8/1980 | | |
| JP | S55103236 A | 8/1980 | | |
| WO | WO-2014168028 A1 * | 10/2014 | | B21D 53/36 |

* cited by examiner

*Primary Examiner* — Pradeep C Battula
(74) *Attorney, Agent, or Firm* — Harness, Dickey & Pierce, P.L.C.

(57) ABSTRACT

A fine blanking cam die for removing a slug from a workpiece includes an axially moveable punch, laterally moveable cam dies and a driver engaged with at least one of the cam dies. The laterally moveable cam dies define an aperture to receive the punch. Movement of the driver causes movement of at least one of the cam dies such that a side force is applied to a slug of material being formed as the punch travels through the workpiece.

12 Claims, 3 Drawing Sheets

FINE BLANKING CAM DIE

FIELD

The present disclosure relates to a machine and method for shearing a metal sheet.

BACKGROUND

This section provides background information related to the present disclosure which is not necessarily prior art.

Depending on the desired geometry of a finished stamped component, it may be desirable to achieve flatness and cut edge characteristics that were previously unobtainable by traditional stamping and punching methods. Fine blanking machines have been created to achieve these desired goals. A typical fine blanking machine utilizes three high-pressure pads and a special press. The pads hold the metal during the cutting process to keep the metal from plastically deforming during punch entry.

Fine blanking machines typically incorporate a V-ring into one of the high-pressure pads. This ring is commonly referred to as a "stinger" or "impingement" ring. Before the punch contacts the workpiece, the ring impales the workpiece and restricts the metal from moving outwardly. One of the high-pressure pads within the fine blanking machine is often referred to as a counterpunch. The counterpunch is positioned on an opposite side of the workpiece as the punch. The punch and the counterpunch tightly grip the slug of material that is removed from the workpiece during the fine blanking process. Typically, the fine blanking machine is equipped with nitrogen or hydraulic manifolds to achieve a high pressure clamping of the workpiece and the slug that is soon to be formed between the pads of the press. As should be appreciated, typical fine blanking machines are relatively complex and expensive to manufacture. Accordingly, it may be desirable to create a fine blanking cam die operable to perform sheet metal stamping operations with improved cut-edge characteristics using a simplified and more cost effective machine.

In one instance, it may be desirable to utilize a conventional standard mechanical or hydraulic press to perform a fine blanking operation using the fine blanking cam die described in the following description.

SUMMARY

This section provides a general summary of the disclosure, and is not a comprehensive disclosure of its full scope or all of its features.

A fine blanking cam die for removing a slug from a workpiece includes an axially moveable punch, laterally moveable cam dies and a driver engaged with at least one of the cam dies. The laterally moveable cam dies define an aperture to receive the punch. Movement of the driver causes movement of at least one of the cam dies such that a side force is applied to a slug of material being formed as the punch travels through the workpiece.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
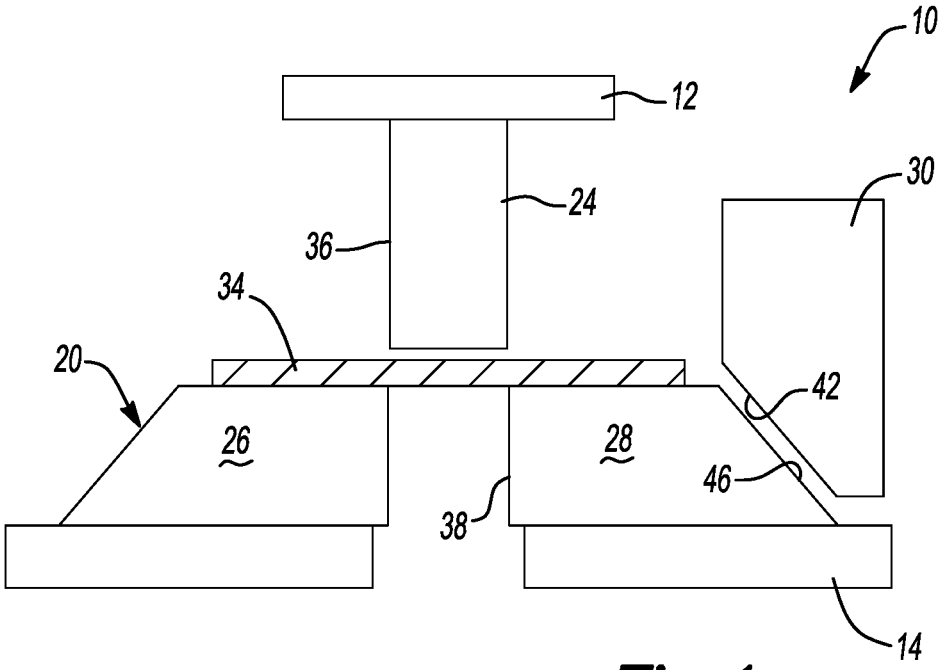
FIG. 1 depicts an exemplary mechanical press equipped with a fine blanking cam die constructed in accordance with the teachings of the present disclosure.

FIG. 1 depicts an exemplary mechanical press 10 including an axially moveable ram 12 and a base 14. A fine blanking cam die 20 is positioned between ram 12 and base 14. Fine blanking cam die 20 includes an axially moveable punch 24, cams 26, 28, and a driver 30. A workpiece 34 is positioned between punch 24 and cams 26, 28.

Prior to engagement of punch 24 with workpiece 34, cams 26, 28 are spaced apart from one another to provide an initial cutting clearance between an external surface 36 of punch 24 and an internal surface 38 defined by cams 26, 28. The initial cutting clearance lies within a range of 10-50% of the thickness of workpiece 34. Workpiece 34 is restricted from translating relative to ram 12 and base 14 of the press by locating features that are positioned on a component other than translatable cams 26, 28 such as a die shoe, not shown in the figures. It should be appreciated that more than two cams may be implemented if necessary to account for the size and shape of the aperture to be formed in the workpiece. Aperture 38 need not be circular in shape.

Figure 2:
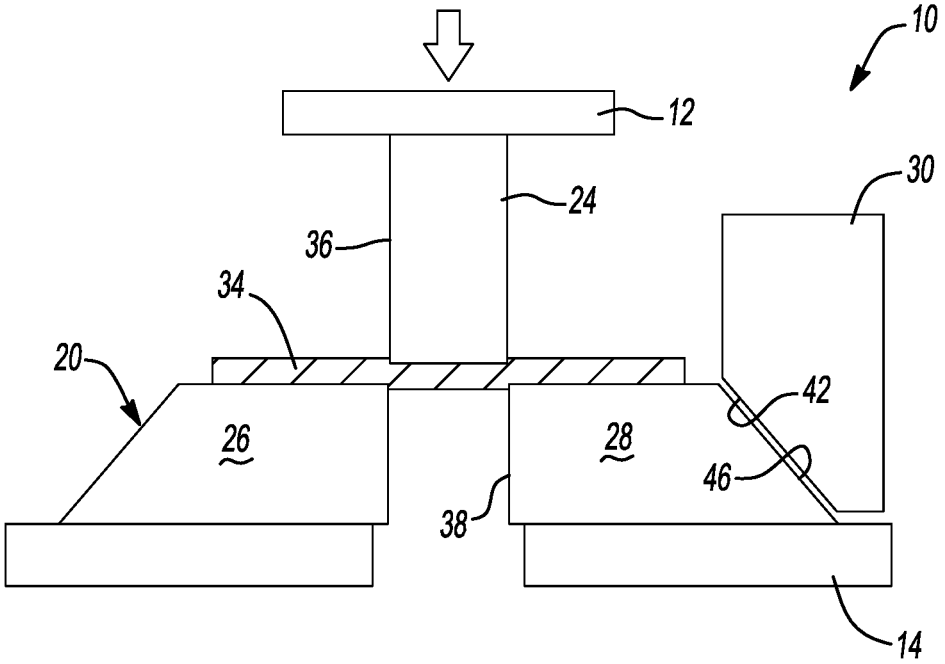
FIG. 2 depicts a punch partially advanced into a workpiece positioned within the fine blanking cam die.
Figure 5:
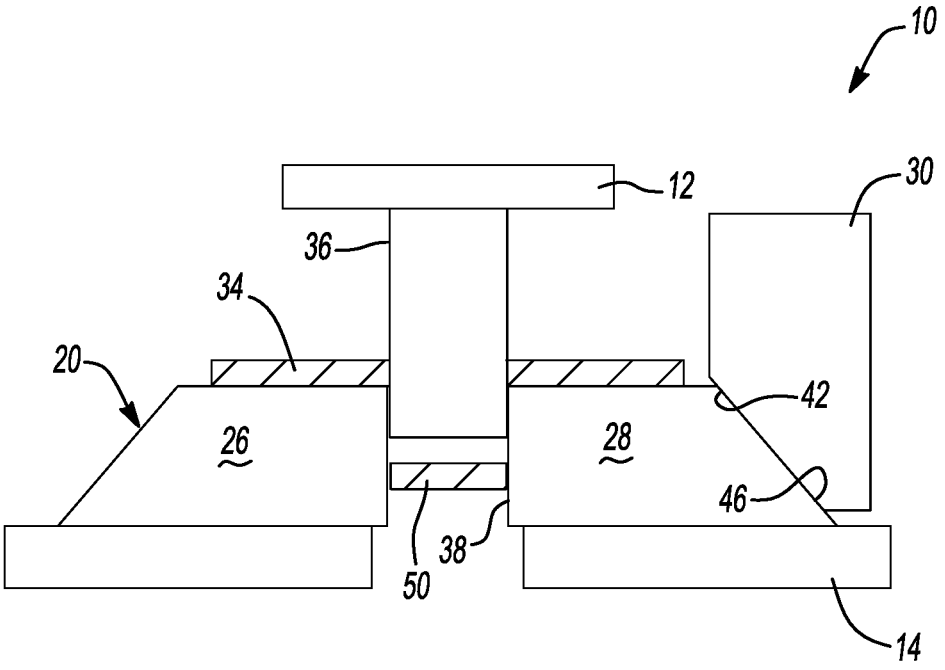
FIG. 5 depicts the slug entirely removed from the workpiece as the punch approaches a fully extended position.

During fine blanking, a force is applied to driver 30. A driving face 42 of driver 30 may be spaced apart from a driven face 46 of cam 28 as punch 24 engages workpiece 34 and begins to create a slug 50 (FIG. 5). Alternatively, driving face 42 may be positioned in engagement with driven face 46 while cams 26, 28 are positioned at the 10-50% cutting clearance position. Regardless, cams 26, 28 are not translated toward one another until punch 24 protrudes through approximately 20-25% of the thickness of workpiece 34. FIG. 2 depicts one arrangement of the components of fine blanking cam die 20 at the position where punch 24 extends into the workpiece 20-25% of the workpiece thickness. The force applied to driver 30 may be provided by ram 12 or an alternate source.

Figure 3:
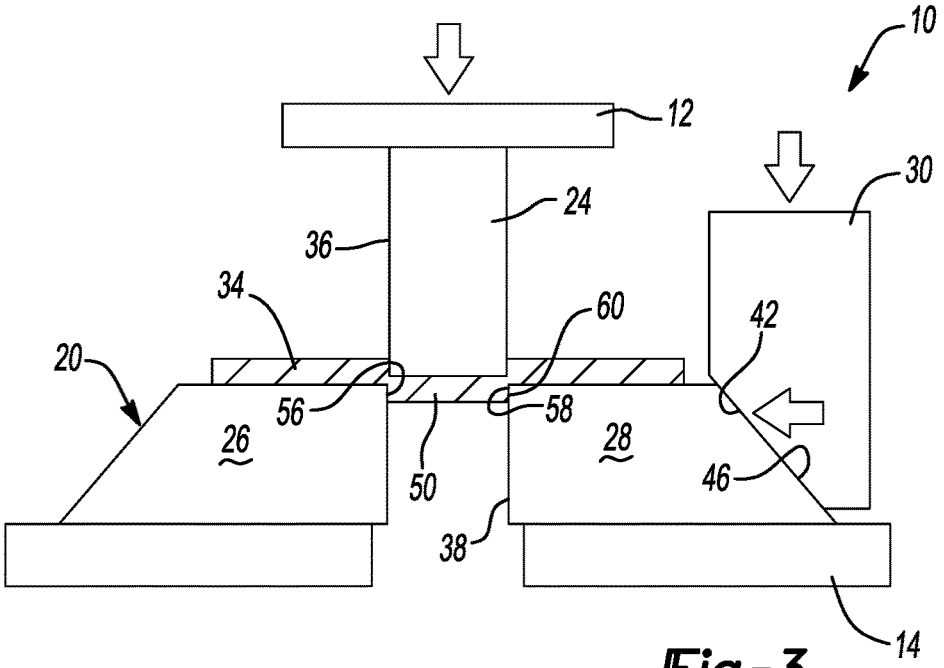
FIG. 3 depicts a driver urging a cam die into engagement with a slug being formed as the punch continues to travel through the workpiece.

FIG. 3 illustrates an axial force being applied to both punch 24 and driver 30 to translate cams 26, 28 toward one another. More particularly, upper edge portions 56, 58 of cams 26, 28 are driven into engagement with an external surface 60 of slug 50. As punch 24 continues to pass through workpiece 34, cams 26, 28 are moved to positions where clearance between the outer surface of punch 24 and the inner surface defined by cams 38 approaches zero cutting clearance. The rate of punch movement compared to the rate of driver and cam movement are adjustable to maximize the extent of a shear land created during the stamping operation. As would follow, the amount of break-out on the non-entry side of the workpiece is minimized as the shear land extent is increased.

Figure 4:
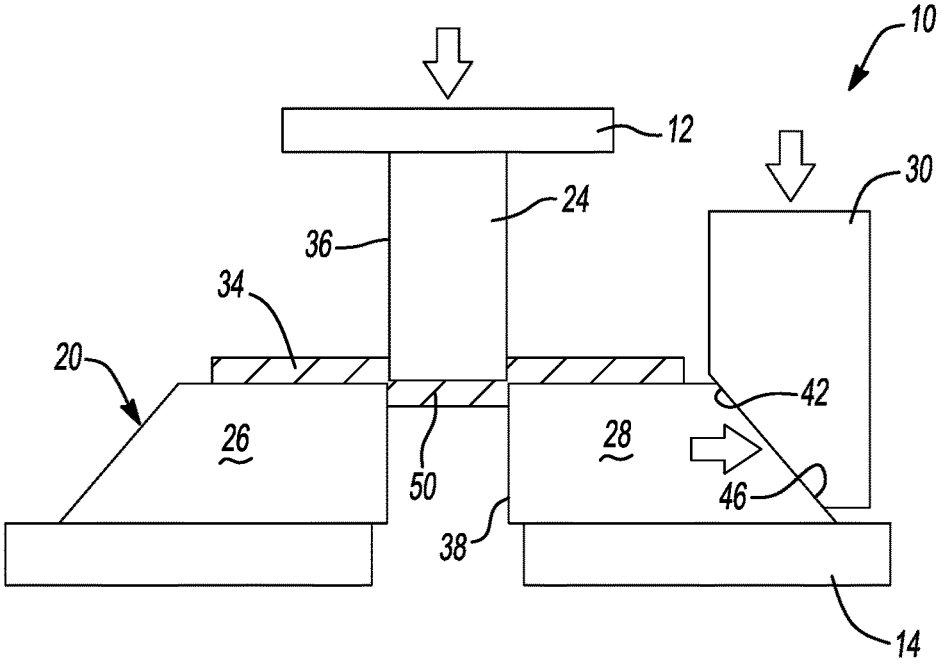
FIG. 4 depicts cam dies located at a substantially zero clearance position.

FIG. 4 depicts cams 26, 28 being held into the position where minimal clearance exists between punch external surface 36 and surface 38. Ram 12 and punch 24 continued to be axially translated while cams 26, 28 are restricted from movement.

FIG. 5 depicts punch 24 extending completely through workpiece 34 and slug 50 being completely separated from workpiece 34. It is estimated that the clean shear land extent would be approximately 70% of the thickness of workpiece 34.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of fine blanking a slug from a workpiece, the method comprising:

positioning a fine blanking cam die between a moveable ram and a base of a press;

positioning a sheet metal workpiece between an axially moveable punch and laterally moveable cam dies;

advancing the punch toward the workpiece and partially piercing the workpiece as the punch travels into the workpiece 20-25% of its thickness;

translating at least one of the cam dies toward the slug to decrease a clearance between the cam dies and the punch after the punch has traveled into the workpiece 20-25% of its thickness such that the cam dies apply a side force to the slug material being formed as the punch continues to travel through the workpiece; and advancing the punch through the workpiece to separate the slug from the workpiece.

2. The method of claim 1, wherein the cam dies define an aperture having a size greater than a size of the punch, wherein a clearance between the aperture of the cam dies and the punch ranges from 10-50% of the workpiece thickness during a time beginning when the punch initially contacts the workpiece up until the punch travels into the workpiece 20-25% of its thickness.

3. The method of claim 2, wherein the aperture is sized to provide substantially zero clearance to the punch after the punch has traveled into the workpiece 20-25% of its thickness.

4. The method of claim 2, further including engaging an axially moveable driver with at least one of the cam dies to move the cam die, and reduce the size of the aperture.

5. The method of claim 4, wherein the punch and the driver are simultaneously moved during at least a portion of the fine blanking process.

6. A fine blanking cam die for removing a slug from a workpiece, the die comprising:

an axially moveable punch;

laterally moveable cam dies defining an aperture to receive the punch; and a driver engaged with at least one of the cam dies, wherein movement of the driver causes movement of the at least one cam die to change a size of the aperture, wherein movement of the at least one cam die in relation to movement of the punch is controlled such that the cam dies apply a side force to the slug of material being formed as the punch travels through the workpiece.

7. The die of claim 6, wherein the driver is axially moveable.

8. The die of claim 7, wherein the driver includes a driving face in engagement with a driven face on one of the cam dies.

9. The die of claim 6, wherein the at least one cam die is moved to change the size of the aperture after the punch travels a predetermined distance.

10. The die of claim 6, wherein the aperture is initially sized to provide a predetermined clearance to the punch.

11. The die of claim 10, wherein the aperture is subsequently sized to provide zero clearance to the punch.

12. A method of fine blanking a slug from a workpiece, the method comprising:

providing a mechanical press having a moveable ram;

positioning the fine blanking cam die of claim 6 within the press; and moving the ram to move the punch and form the slug.

* * * * *